US005843345A

United States Patent [19]

Guntly

[11] Patent Number: 5,843,345

[45] Date of Patent: Dec. 1, 1998

[54] PNEUMATIC ACCELERATOR FOR LOW EMISSION CHARGE FORMING DEVICES

[75] Inventor: Thomas G. Guntly, Hartford, Wis.

[73] Assignee: Briggs & Stratton Corporation, Wauwatosa, Wis.

[21] Appl. No.: 818,585

[22] Filed: Mar. 14, 1997

Related U.S. Application Data

[63] Continuation-in-part of Ser. No. 577,722, Dec. 22, 1995, abandoned.

[51] Int. Cl.[6] ..... F02M 7/093

[52] U.S. Cl. ..... 261/34.2; 261/35

[58] Field of Search ..... 261/34.2, 26, 51, 261/35, 70, 27, DIG. 19, DIG. 39, DIG. 69, DIG. 68

[56] References Cited

U.S. PATENT DOCUMENTS

| | | | |
|---|---|---|---|
| 1,803,012 | 4/1931 | Goudard | 261/34.2 |
| 1,853,287 | 4/1932 | Schweiss et al. | 261/34.2 X |
| 1,881,559 | 10/1932 | Heitger | 261/34.2 |
| 1,946,284 | 2/1934 | Huber | 261/34.2 |
| 2,020,418 | 11/1935 | Jacks | 261/34.2 |
| 2,186,480 | 1/1940 | Ensign | 261/34.2 |
| 2,363,223 | 11/1944 | Bonnier | 261/34.2 |
| 2,389,922 | 11/1945 | Mennesson | 261/34.2 |
| 2,403,390 | 7/1946 | Moseley et al. | 261/34.2 |
| 2,406,114 | 8/1946 | Sloane et al. | 261/34.2 |
| 2,458,990 | 1/1949 | Griffon | 261/34.2 |
| 2,472,692 | 6/1949 | Brown | 261/34.2 |
| 2,529,655 | 11/1950 | Henning | 261/34.2 |
| 2,551,719 | 5/1951 | Ball | 261/34.2 |
| 2,563,096 | 8/1951 | Bicknell | 261/34.2 |
| 2,641,237 | 6/1953 | Deschamps | 123/364 |
| 2,649,290 | 8/1953 | Griffon | 261/34.2 |
| 2,775,435 | 12/1956 | Kommer | 261/34.2 |
| 3,291,464 | 12/1966 | Hammerschmidt et al. | 261/142 |
| 3,531,094 | 9/1970 | Andrew | 261/26 X |
| 3,566,847 | 3/1971 | Schnoll et al. | 123/492 |
| 3,661,367 | 5/1972 | Mennesson | 261/DIG. 19 |
| 3,689,036 | 9/1972 | Kikuchi et al. | 261/51 X |
| 3,690,625 | 9/1972 | Ishida | 261/DIG. 69 |
| 3,743,254 | 7/1973 | Tuckey | 261/35 X |
| 3,767,173 | 10/1973 | Ishii | 261/DIG. 68 |
| 3,779,529 | 12/1973 | Kimura | 261/35 |
| 3,964,503 | 6/1976 | Kikuchi | 261/70 X |
| 4,076,770 | 2/1978 | Saito et al. | 261/34.2 |
| 4,168,680 | 9/1979 | Kawai et al. | 261/DIG. 19 |
| 4,205,024 | 5/1980 | Hirosawa | 261/DIG. 39 |
| 4,325,349 | 4/1982 | Fehrenbach | 261/DIG. 19 |
| 4,387,676 | 6/1983 | Couceiro | 261/142 X |
| 4,390,480 | 6/1983 | Noisier | 261/34.2 |
| 4,424,785 | 1/1984 | Ishida et al. | 123/479 |
| 4,448,280 | 5/1984 | Endo | 181/229 |
| 4,559,185 | 12/1985 | Seto et al. | 261/DIG. 39 |
| 4,671,220 | 6/1987 | Inoue et al. | 261/34.2 X |
| 4,765,932 | 8/1988 | Muraji | 261/27 |
| 4,957,664 | 9/1990 | Kohno et al. | 261/34.2 |
| 4,971,013 | 11/1990 | Muraji et al. | 123/463 |
| 4,984,547 | 1/1991 | Muraji | 123/463 |
| 4,986,240 | 1/1991 | Muraji et al. | 123/452 |
| 5,031,596 | 7/1991 | Muraji | 123/463 |
| 5,119,787 | 6/1992 | Muraji | 123/463 |
| 5,240,649 | 8/1993 | Yamada et al. | 261/34.2 |
| 5,250,233 | 10/1993 | Swanson | 261/34.2 |
| 5,494,613 | 2/1996 | Rush, II et al. | 261/34.2 |

FOREIGN PATENT DOCUMENTS

| | | |
|---|---|---|
| 1071686 | 9/1954 | France . |
| 2106687 | 5/1972 | France . |
| 63-285251 | 11/1988 | Japan . |
| 59-147853 | 8/1994 | Japan . |
| 257313 | 8/1926 | United Kingdom . |
| 1 262 597 | 2/1972 | United Kingdom . |
| 1323016 | 7/1973 | United Kingdom . |

*Primary Examiner*—Richard L. Chiesa
*Attorney, Agent, or Firm*—Michael, Best & Friedrich LLP

[57] ABSTRACT

An accelerator having a main body defining a main chamber, a movable member (e.g., a diaphragm) positioned within and dividing the main chamber into a pneumatic chamber and a fuel chamber, and a damping orifice (e.g., in the main body) interconnecting the pneumatic chamber with a gas source (e.g., ambient air). The damping orifice has a cross sectional area less than about 0.002 square inches. To inhibit contamination of the accelerator, a filter can be operatively positioned between the pneumatic chamber and the ambient air.

20 Claims, 5 Drawing Sheets

PNEUMATIC ACCELERATOR FOR LOW EMISSION CHARGE FORMING DEVICES

This application is a continuation in part of application Ser. No. 08/577,722, filed Dec. 22, 1995, and now abandoned.

FIELD OF THE INVENTION

The present invention generally relates to the field of charge forming devices, and more particularly to the field of accelerators that enrich fuel-to-air ratios in carburetors during sudden load application.

BACKGROUND OF THE INVENTION

Emissions regulations for small internal combustion engines require that these engines undergo substantial changes to reduce the amount of emissions (e.g., carbon monoxide). To achieve reduced emissions, it is common to adjust the carburetor or other charge forming device so that the engine runs on a leaner fuel mixture. One problem with lean fuel mixtures is that the engine has a tendency to stumble or stall during sudden load application. That is, when a sudden load is applied, the governor will react suddenly by opening the throttle, causing rapid enleanment of the fuel mixture beyond the limit of good combustion, and possibly resulting in stalling of the engine.

To alleviate this problem, accelerators have been added to fuel delivery systems for combustion engines. For example, it is known to use pneumatic accelerators that are actuated by changing pressure in the throat of a carburetor. Pneumatic accelerators typically include a movable member (e.g., a flexible diaphragm or slidable piston) positioned within and dividing a main chamber into a fuel chamber and a pneumatic chamber. The fuel chamber is operatively interconnected with the float bowl and fuel nozzle, and the pneumatic chamber is operatively interconnected with a section of the carburetor throat. When the engine is running at no load steady-state, a throat pressure is communicated to the pneumatic chamber and the movable member is allowed to move toward the pneumatic chamber, resulting in fuel being drawn into the fuel chamber. When a load is applied to the engine, another throat pressure is communicated to the pneumatic chamber and the movable member is allowed to move toward the fuel chamber, resulting in pressurized fuel being forced into the fuel nozzle. The pressurized fuel in the fuel nozzle alleviates the problem of extreme enleanment of the fuel mixture.

Because of the moving parts, the above-described accelerator can wear out over time. For example, when a flexible diaphragm is used as the movable member, the diaphragm can eventually fail due to fatigue. This is particularly true in single cylinder engines, where the throat pressure can oscillate to highly negative or highly vacuum pressures during steady-state idle operation. Such steady-state oscillation can prematurely fatigue the diaphragm, and can also undesirably pump pressurized fuel into the fuel nozzle when it is not needed.

SUMMARY OF THE INVENTION

The present invention enhances the operation of accelerators by reducing the amount of fatigue stress encountered by the movable member, particularly when used on single or dual cylinder engines. The fatigue stress is reduced by damping the peak vacuum throat pressure (i.e., lowest absolute pressure) communicated to the pneumatic chamber of the accelerator. The damping of the peak vacuum throat pressure reduces the amplitude of oscillation of the movable member during steady-state idle, thereby reducing stress on the movable member and limiting the amount of fuel that is undesirably pumped into the fuel nozzle at steady-state.

In one aspect, the present invention provides a charge forming device including a body having an intake passageway or throat, an accelerator device having a pneumatic chamber that is operatively interconnected with the intake passageway such that pressure fluctuations in the intake passageway are communicated to the pneumatic chamber, and a damper for damping the lowest vacuum pressures communicated to the pneumatic chamber. In one embodiment, the damper includes a damping orifice (e.g., in the wall of the pneumatic chamber) interconnecting the pneumatic chamber with a gas source (e.g., ambient air). The damping orifice is sized so that ambient air is allowed to pass into the pneumatic chamber in response to relatively low vacuum pressure conditions, thereby increasing the effective pressure in the pneumatic chamber to a pressure that is generally 2 psi to 11 psi greater than the lowest vacuum pressures communicated from the throat to the pneumatic chamber. As a result, the effect of the low vacuum pressures on the movable member is minimized. In alternative embodiments, the damping orifice can have a cross sectional area less than about 0.002 square inches (0.050 dia.), preferably less than about 0.0005 square inches (0.025 dia.), and more preferably about 0.00018 square inches (0.015 dia.). To inhibit contamination of the accelerator, a filter can be operatively positioned between the pneumatic chamber and the gas source.

In another aspect, the invention provides an accelerator having a main body defining a main chamber, a movable member (e.g., a diaphragm) positioned within and dividing the main chamber into a pneumatic chamber and a variable volume fuel chamber, and a damper for damping pressure fluctuations communicated to the pneumatic chamber. The main body can include a fuel orifice for receiving fuel in the fuel chamber and a vent passageway for bleeding air out of the fuel chamber during filling of the fuel chamber so that the fuel chamber can be substantially filled with fuel.

In yet another embodiment of the invention, a variable volume fuel chamber is positioned above the liquid level of a main fuel chamber of the carburetor. A pathway operatively interconnects the main fuel chamber with the variable volume fuel chamber such that when the movable member retracts in response to low pressure in the pneumatic chamber, fuel is drawn into the fuel chamber via the pathway. Conversely, when the movable members expands in response to higher pressure in the pneumatic chamber, fuel is moved down the pathway and into the fuel nozzle. A damper assists in preventing fuel from being prematurely moved down the pathway as a result of movement of the movable chamber by damping the effect of pressure fluctuations communicated to the pneumatic chamber.

DETAILED DESCRIPTION

Figure 1:
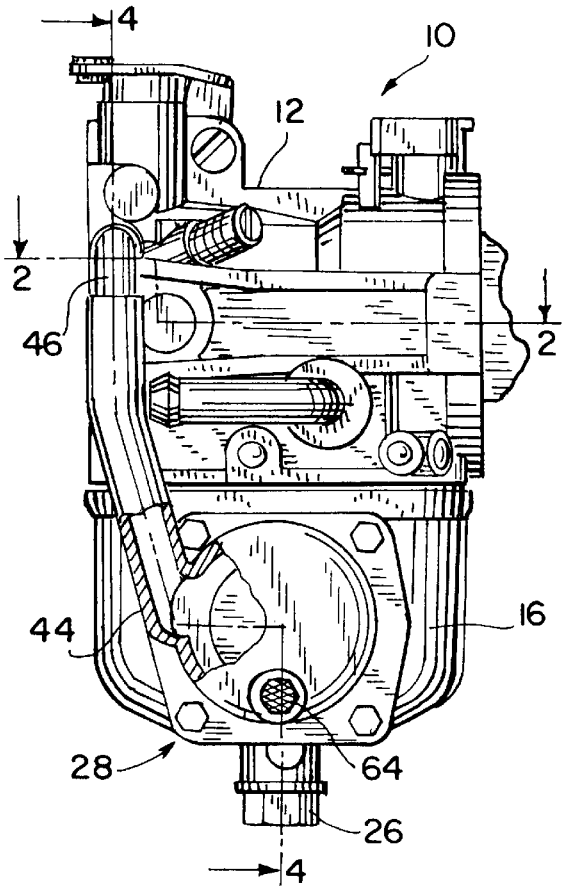
FIG. 1 is a partially-sectioned side view of a carburetor embodying the present invention.

FIGS. 1–6 illustrate one embodiment of the present invention. The illustrated embodiment is a carburetor 10 including a carburetor body 12 having an intake passageway or throat 14 extending therethrough, a fuel bowl 16 secured to the carburetor body 12, and a carburetor stem 18 (FIG. 3) that holds a main jet 20 in position for providing fuel to the throat 14. In FIGS. 3–6, the main jet 20 includes a counterbore 21 (FIG. 6) and a metering orifice 22 that lead to a fuel nozzle 23. The stem 18 includes two opposing side openings 24, having a diameter of about 0.093 inches, that provide a pathway for fuel to travel from the fuel bowl 16 to the main jet 20. A bowl nut 26 is threaded through the bottom of the stem 18.

Figure 2:
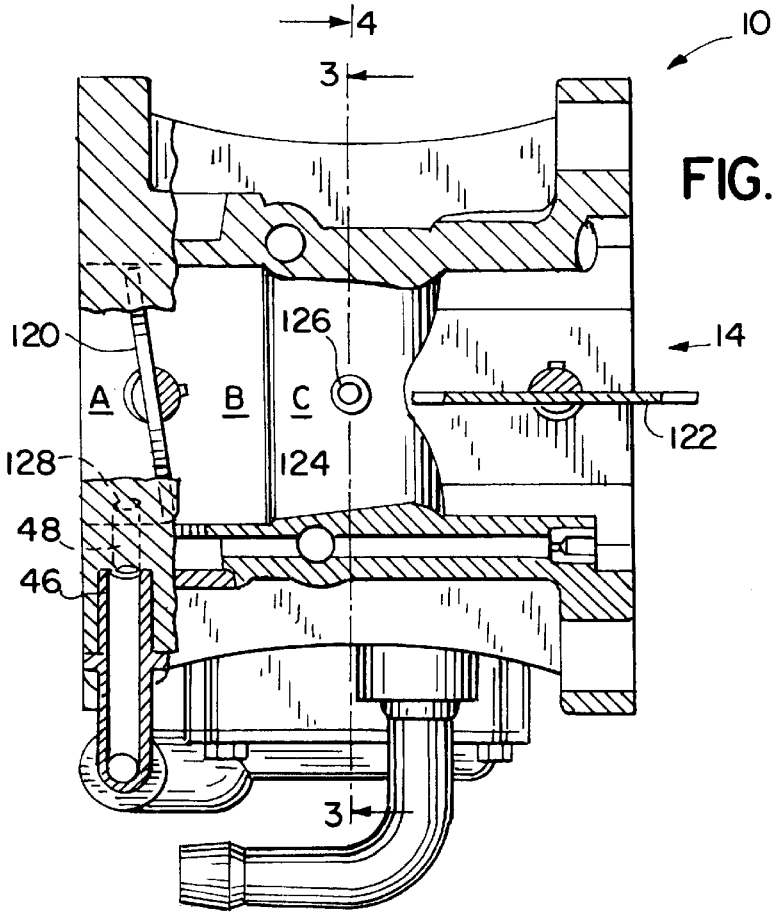
FIG. 2 is a partially-sectioned top view of the carburetor illustrated in FIG. 1.

The throat 14 includes a throttle valve 120 ("throttle") mounted on the engine manifold side of the throat 14 and a choke valve 122 ("choke") mounted on the suction side of the throat 14 (see FIG. 2). Between the throttle 120 and the choke 122, a venturi device 124 is integrally formed with the carburetor body 12. A fuel nozzle opening 126 is centrally located in the venturi 124 and fluidly communicates with the flow stream in the venturi 124.

FIG. 2 depicts the arrangement of the throttle 120 (a butterfly valve), venturi 124, and choke 122 inside the throat 14. The throttle 120 is in the substantially closed position, as is typical when the engine is idling. During normal engine loading, the throttle 120 is partially to substantially open and the intake stroke of the piston causes air to be drawn past the choke 122, through the venturi 124, and past the throttle 120. The increased velocity of the air flow through the venturi 124 draws a pre-determined rate of fuel flow from the fuel nozzle opening 126 to produce a combustible mixture.

The illustrated carburetor 10 further includes an accelerator device 28 integral with the fuel bowl 16. The accelerator device 28 is designed to provide additional fuel (i.e., in addition to the fuel normally provided by fuel nozzle 23) to the throat 14 during sudden load applications (e.g., when the throttle 120 is suddenly opened thereby allowing an increased flow of air through the throat 14). As best shown in FIGS. 3–6, the accelerator device 28 includes a main body 30 defining a main chamber. A moveable member in the form of a diaphragm 34 is positioned within, and divides, the main chamber into a pneumatic chamber 36 and a fuel chamber 38. The diaphragm 34 is designed so that it can move within the main chamber, thereby varying the respective volumes of fluid in the pneumatic chamber 36 and in the fuel chamber 38. A compression spring 40 is positioned within the pneumatic chamber 36 between the diaphragm 34 and the main body 30, and is designed to bias the diaphragm 34 toward the fuel chamber 38.

Referring again to FIGS. 3–6, the main body 30 includes an input orifice 42 that provides communication between the pneumatic chamber 36 and a tube member 44 formed integrally with the main body 30. A conduit member 46 provides operative connection between the tube member 44 and the carburetor body 12, and a restrictor 48 provides a pathway between the conduit member 46 and the throat 14. The restrictor 48 has an open end or pneumatic chamber opening 128 that is positioned at throat area A, downstream of the throttle 120 (FIG. 2). The illustrated restrictor 48 has a diameter of about 0.018 inches. The input orifice 42, tube member 44, conduit member 46, and restrictor 48 provide operative interconnection between the pneumatic chamber 36 and the throat area A. When the pressure that is common to the throat area A and the pneumatic chamber is substantially equal to the pressure in the fuel chamber 38, the force exerted by the compression spring 40 will move the diaphragm 34 toward the fuel chamber 38. Since the pressure in the fuel bowl is generally constant at a given speed and load (i.e., hydrostatic pressure), the movement of the diaphragm 34 will be primarily dependent on changes in the pressure in the pneumatic chamber 36. Accordingly, the diaphragm 34 will be acted upon by, and will move in response to, pressure fluctuations in throat area A.

Figure 3:
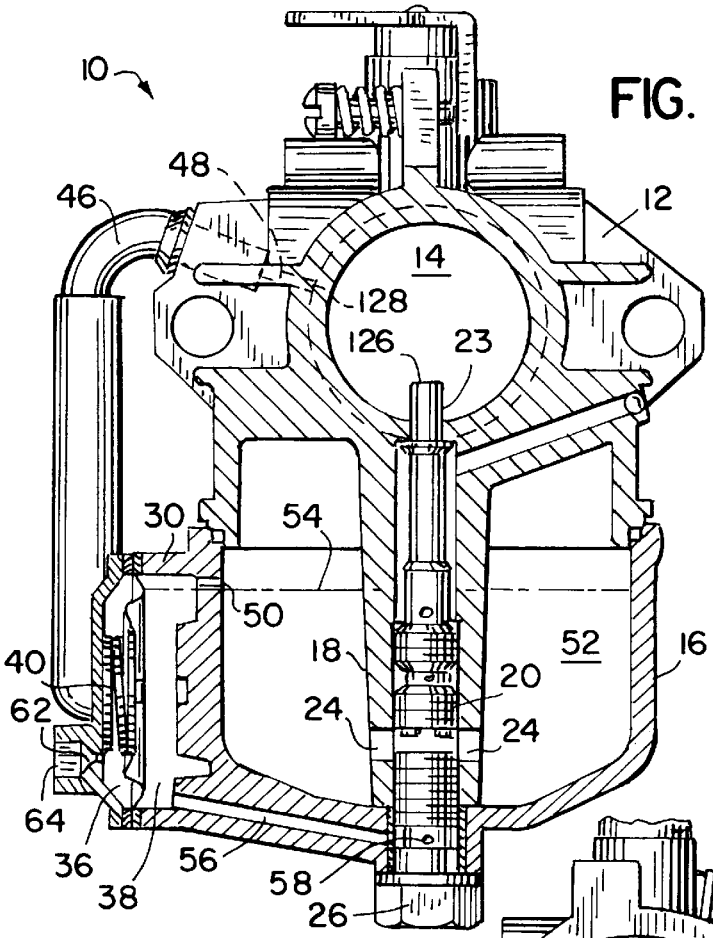
FIG. 3 is a sectional end view of the carburetor illustrated in FIG. 2.
Figure 4:
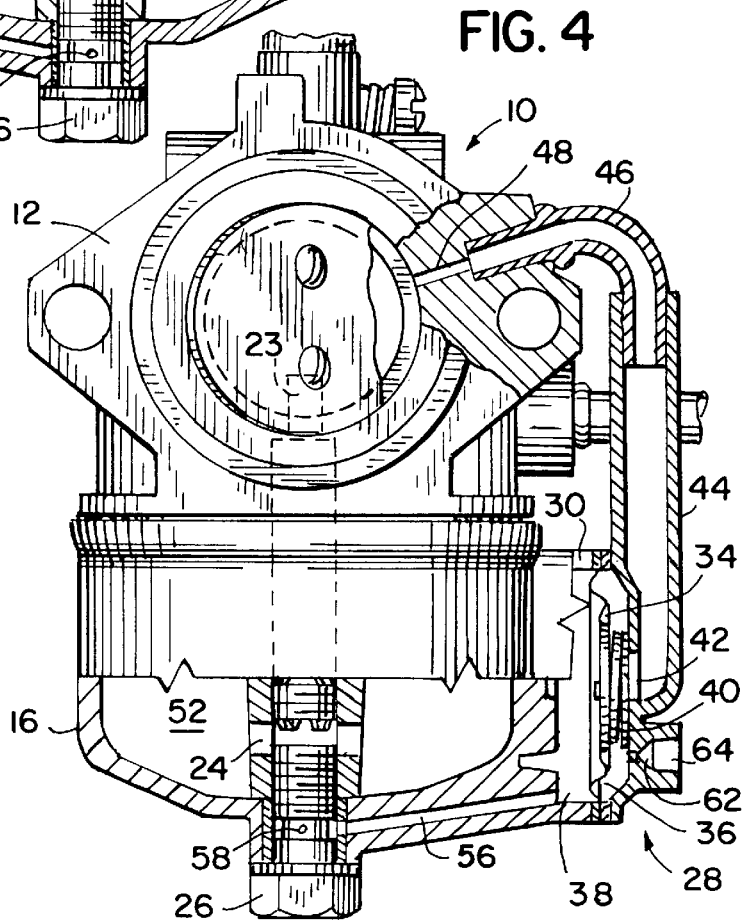
FIG. 4 is a partially-sectioned end view of the carburetor illustrated in FIG. 1.
Figure 5:
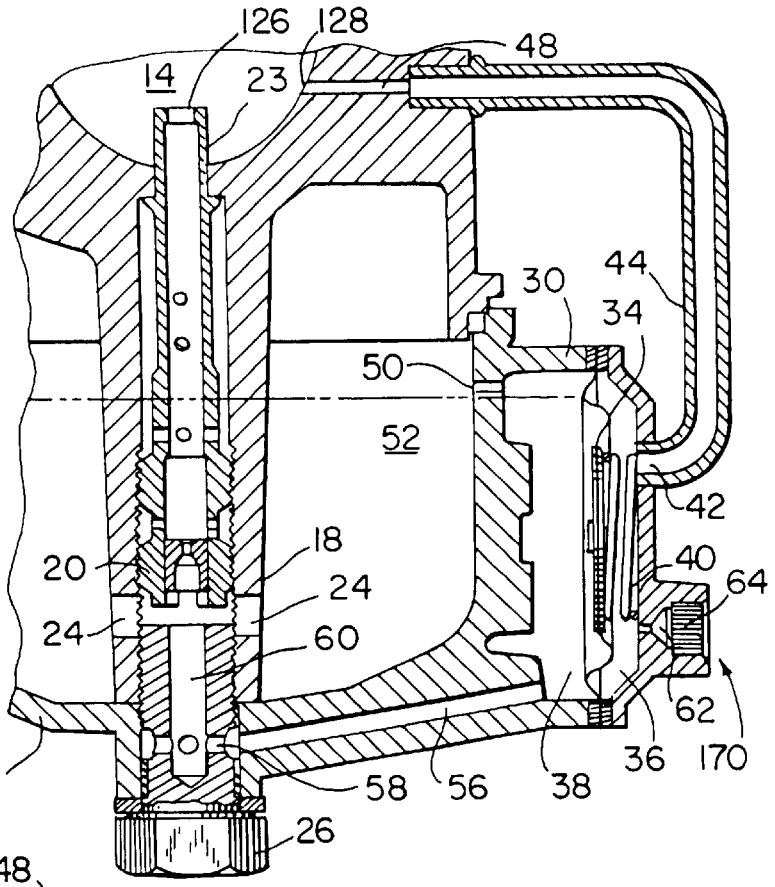
FIG. 5 is a schematic of the carburetor illustrating the accelerator with the diaphragm in a retracted position and the fuel chamber full.
Figure 6:
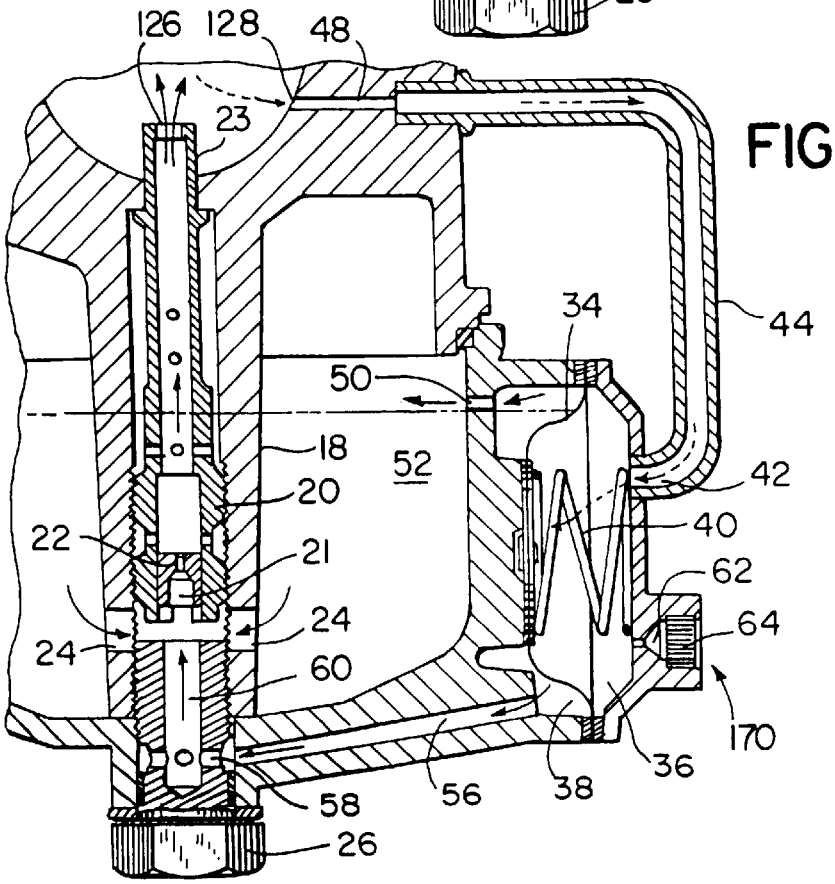
FIG. 6 is a schematic of the carburetor illustrating the accelerator with the diaphragm in an expanded position and fuel being discharged from the fuel chamber to the main jet.

As best shown in FIGS. 3, 5, and 6, an air discharge opening 50 interconnects the fuel chamber 38 and the interior 52 of the fuel bowl 16. The air discharge opening 50 is positioned near an upper portion of the fuel bowl 16 so that the air discharge opening 50 is above the fuel level 54 at normal running position. The air discharge opening 50 is designed to allow air to escape the fuel chamber 38 so that fuel can occupy substantially the entire volume of the fuel chamber 38. The air discharge opening 50 is sized to allow air to pass therethrough, while substantially preventing fuel from passing therethrough. Accordingly, an insubstantial amount of fuel will pass through the air discharge opening 50 when the diaphragm 34 directs fuel from the fuel chamber 38 into the main jet 20.

The air discharge opening 50 preferably is circular in cross-section and has a diameter between about 0.010 and about 0.030 inches. In the illustrated embodiment, the air discharge opening 50 has a diameter of about 0.016 inches. It should be noted that the accelerator device 28, specifically the fuel chamber 38, will also be operative with an air discharge opening having one end in the fuel chamber and an opposite end near the upper portion of the fuel bowl 16, but below the fuel level 54.

In FIGS. 3–6, a fuel path 56, having a diameter of about 0.058 inches, provides operative connection between the fuel chamber 38 and the carburetor stem 18. In this regard, the bowl nut 26 includes a plurality of side ports 58 and an axial aperture 60 (FIGS. 5 and 6) to provide operative interconnection between the fuel path 56 and the main jet 20. The axial aperture 60 is positioned coaxial with the main jet 20. It is noted that the interconnection between the fuel chamber 38 and the main jet 20 is substantially sealed except for side openings 24 in the stem 18, thereby lessening pressure loss.

Utilizing the above-described arrangement, it has been discovered that fuel output through the fuel nozzle 23 is enhanced when the diameter of the axial aperture 60 is within a certain range of the diameter of the counterbore 21. More specifically, the axial aperture 60 should have a diameter no greater than about two times, and preferably no greater than about one and one-half times, the diameter of the counterbore 21. In addition, the end of the axial aperture 60 preferably is not spaced from the counterbore 21 by more than twice the diameter of the counterbore 21. In the illustrated embodiment, the diameter of the counterbore 21 is about 0.058 inches, the diameter of the axial aperture 60 is about 0.089 inches, and the distance between the end of the axial aperture 60 and the counterbore 21 is about 0.093 inches.

During the intake stroke, the piston moves downward in the cylinder, thereby creating a low pressure area that extends into the throat 14. When the throttle 120 and choke 122 are open (e.g., during normal loading), this low pressure condition draws air into the throat 14 and a combustible mixture into the cylinder. As the air flows through the venturi 124, an even lower pressure area is created near the fuel nozzle opening 126 depending on the velocity of the air flow. A significant pressure difference between the throat area at the venturi 124 and the fuel bowl 16 draws fuel from the fuel bowl 16 into the fuel nozzle 23 and into the throat 14 to mix the with air, thereby producing the flow of combustible mixture.

As shown in FIG. 2, the pneumatic chamber opening 128 is positioned just downstream of the throttle 120 at throat area A. When the throttle 120 is wide open, the pressure at throat area A is not much lower than the pressure just upstream of the throttle 120 at throat area B. When the throttle 120 is gradually closed so as to restrict flow (i.e., when the engine load is lessened), the flow in the throat 14 decreases and the pressures at throat area B and throat area C rises while the pressure at throat area A decreases. Thus, the difference between the pressure at throat area C and the pressure in the fuel bowl 16 decreases, thereby slowing the fuel flow through the fuel nozzle 23.

At idle speed, the throttle 120 is practically closed and very little air passes through the venturi 124. At this speed, the difference between the pressure at throat area C (which is now typically close to atmospheric pressure) and the pressure in the fuel bowl 16 is very small and further slows or stops fuel flow through the fuel nozzle 23. At idle speed, the pressure at throat area A and in the pneumatic chamber 36, which is fluidly interconnected with throat area A, is lower than when the throttle 120 was substantially open. Consequently, the pressure difference between the fuel chamber 38 and the pneumatic chamber 36 is sufficient to overcome the spring force exerted by the compression spring 40 and to move the diaphragm 34 toward the pneumatic chamber 36 to the retracted position. As a result, the volume capacity of the fuel chamber 38 expands, thereby drawing fuel into the fuel chamber 38 from the fuel bowl 16 through the side openings 24. Because most of the air escapes through the air discharge opening 50, the fuel chamber 38 is allowed to fill to capacity.

Pressure decrease in the pneumatic chamber 36 is typically gradual, and movement of the diaphragm 34 to the retracted position is even more gradual due to the bias of the compression spring 40 in the opposite direction. Thus, little effect is noticed on the fuel being supplied to the main jet 20. Alternatively, when the throttle 120 is suddenly opened (e.g., when engine load is suddenly increased), the air flow through the throat 14 increases, thereby lowering the pressure at throat C. Accordingly, the pressure difference between the throat area C and the fuel bowl 16 causes an increase in fuel flow through the fuel nozzle 23. Simultaneously, the pressure at throat area A is increased, as well as the pressure in the pneumatic chamber 36. Accordingly, the pressure difference between the fuel chamber 38 and the pneumatic chamber 36 is decreased. Consequently, the force exerted by the compression spring 40 is sufficient to move the diaphragm 34 to the expanded position, resulting in fuel being discharged from the fuel chamber 38 through the axial aperture 60 and toward the coaxial main jet 20. This fuel discharge supplements the fuel normally drawn into the throat 14 through the fuel nozzle 23 and enriches the combustible mixture drawn into the cylinder. Under sudden load applications, pressure increase in throat area A and in the pneumatic chamber 36 is usually rapid and, combined with the force of the compression spring 40, typically results in rapid movement of the diaphragm 34 and significant pressurized fuel being discharged from the axial aperture 60 toward the main jet 20.

It is noted that, because the side openings 24 are positioned adjacent to the main jet 20, the pressure within the fuel path 56 and axial aperture 60 is substantially maintained until the fuel is about to be ejected toward the main jet 20. Due to this arrangement, there is no need for check valves on the side openings 24. The result is that a stream of fuel is discharged directly toward the main jet 20.

The illustrated carburetor 10 further includes a damper 170 for damping high amplitude pressure fluctuations communicated from the throat area A to the pneumatic chamber 36, especially during steady-state idle. More specifically, the damper 170 effectively reduces the effect of the lowest absolute pressures (typically low vacuum pressures in the range of 14.69 psia to 2.0 psia) communicated from the throat area A to the pneumatic chamber 36 and otherwise communicated to the spring 40 and diaphragm 34. Without the damper 170, the low vacuum pressures may cause the diaphragm 34 and spring 40 to oscillate at high amplitudes during engine idle and cause some fuel to be unnecessarily forced out of the fuel chamber 38 and ejected into the throat 14, which makes it difficult to calibrate the carburetor 10 to achieve a desired air/fuel ratio. These high-amplitude oscillations may also cause the diaphragm 34 to prematurely wear out or fatigue.

The damper 170 damps the effect of the lowest vacuum pressures by increasing the effective pressure in the pneumatic chamber 36 to a pressure that is greater than the lowest vacuum pressures. The amount of damping required to prevent undesirable oscillation of the spring 40 and diaphragm 34 is dependent on the characteristics of the engine on which the carburetor 10 is mounted and particularly, the pressure fluctuations expected in the intake manifold of the engine. However, to achieve any measurable damping effect, the damper 174 must generally increase the effective pressure in the pneumatic chamber 36 to a pressure that is at least 2 to 3 psi greater than the lowest vacuum pressures. Further, most spring 40 and diaphragm 34 combinations are designed such that a differential pressure of at least 2 to 3 psi is required to move the diaphragm 34 to its retracted position. Accordingly, the damper 170 is typically designed to be triggered at pressures not greater than 13 psia. In engines where intake manifold pressures as low as 2 psia may be communicated to the pneumatic chamber 36, the damper 170 may be operable to increase the effective pressure in the pneumatic chamber 36 to a pressure of just below 13 psia, or about 11 psi greater than the lowest vacuum pressure (i.e., 2 psia). Thus, a damper 170 according to the present invention may be designed to damp low vacuum pressures communicated to the pneumatic chamber 36 by increasing the pressure in the pneumatic chamber 36 to a pressure that is 2 psi to 11 psi greater than the lowest vacuum pressure communicated to the pneumatic chamber 36.

The damper 170 is especially useful in accelerators for single cylinder or dual cylinder engines. In these engines, the intake manifold pressures can vary widely and can create very low vacuum pressures at the throat area A (i.e., as low as 2 to 4 psia at engine idle depending on the particular engine). In particular, lower overall vacuum pressures are generally found in V-twin engines because there are more negative pressure events per degrees of crank rotation.

The damper 170 according to the present invention includes a damping orifice 62 that interconnects the pneumatic chamber 36 with a volume of gas (FIGS. 3–6). In the illustrated embodiment, the damping orifice 62 interconnects the pneumatic chamber 36 with ambient air. When low vacuum pressures are encountered in throat area A and communicated to the pneumatic chamber 36, air at atmospheric pressure is allowed to enter the pneumatic chamber 36 through the damping orifice 62, thereby increasing the effective pressure in the pneumatic chamber 36. Alternatively, the damper 170 will have the reverse effect (i.e., allow gas to exit the pneumatic chamber 36) when relatively high pressures are communicated to the pneumatic chamber 36.

The amount of gas allowed to enter or exit through the damping orifice 62 is determined primarily by the pressure differential between the pneumatic chamber 36 and the source of gas, the volume of the pneumatic chamber 36, and the dimensions of the damping orifice 62. The design of the damping orifice 62 for a particular type of engine is preferably obtained through experimentation with different orifice dimensions under actual or simulated conditions and in conjunction with the design of the spring 40 and diaphragm 34 configuration. To meet the damping requirements for a particular engine, the configuration of the spring 40 (e.g., the amount of compression in the spring during retraction of the diaphragm 34) and the diaphragm 34 (i.e., the effective surface area of the diaphragm 34) may be varied along with the dimensions of the damping orifice 62 itself.

An important design consideration is that the spring 40 and the diaphragm 34 should completely discharge the fuel in the fuel chamber 38 during expansion of the diaphragm 34. Additionally, it is desirable to design the spring 40, diaphragm 34, and damping orifice 62 such that the accelerator device 28 reacts quickly to sudden load conditions. Given these considerations, the damping orifice 62 illustrated in FIGS. 1–6 has been designed with a diameter less than about 0.050 inches, preferably less than about 0.025 inches, and more preferably about 0.0135 inches.

Alternatively, the damping orifice 62 may be interconnected with a compartment or gas source having a pressure lower than the peak high pressure to be encountered at throat area A. During high peak pressure conditions, pressure in the pneumatic chamber 36 may be partially relieved into the compartment, thereby reducing the effective pressure in the pneumatic chamber 36.

It should be noted that the damping orifice 62 could be positioned at various locations between the pneumatic chamber 36 and the throat 14. For example, instead of being positioned in the pneumatic chamber 36, the damping orifice 62 could instead be positioned in the tube member 44 or conduit member 46. In order to prevent contamination of the accelerator, the damping orifice 62 is provided with a filter element 64. The filter element 64 is designed to inhibit entry of dust, dirt and other foreign substances into the accelerator.

FIGS. 7–11 illustrate a carburetor 66 with an accelerator device 68 positioned adjacent a carburetor body 70 and above a fuel level 72 of a fuel bowl 78. The carburetor 66 is an alternative embodiment of the present invention. This is in contrast to the above-described embodiments, where the accelerator device was positioned adjacent to the fuel bowl and at least partially below the fuel level. The accelerator device 68 includes a diaphragm 152 (other type of movable members would also work), a compression spring 154, a fuel chamber 74, and a pneumatic chamber 134 equipped with a damper 172.

Referring to FIGS. 8–11, the pneumatic chamber 134 is in fluid communication with a throat 156 of the carburetor 66 via a passageway 136. As in the embodiment illustrated in FIGS. 1–6, the damper 172 includes a damping orifice 174 and a filter element 176 (see FIG. 8). The passageway 136 begins at a top portion of the pneumatic chamber 134, winds through the carburetor body 138 and over the throat 156, and connects with a restrictor 158 (see FIGS. 8–11). The restrictor 158 has a pneumatic chamber opening 160 on one end which is in fluid communication with a throat area A' downstream of a throttle valve 162, as in the embodiment illustrated in FIGS. 1–6. Another end of the restrictor 158 is equipped with a plug member 140.

Figure 7:
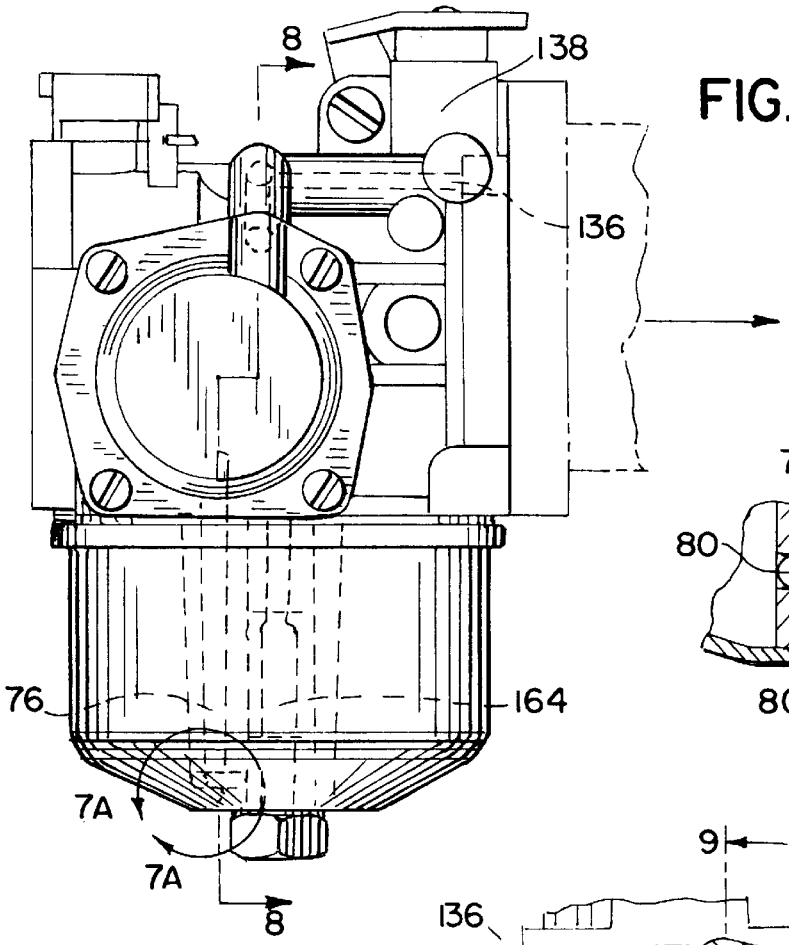
FIG. 7 is a side view of an alternative embodiment of the invention, wherein the main body of the accelerator is integral with the carburetor body.
Figure 7A:
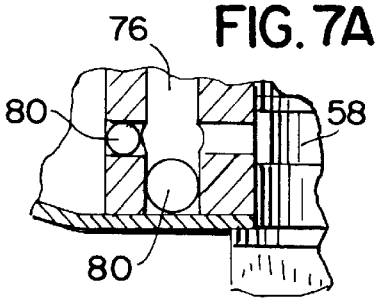
FIG. 7A is an enlarged sectional view of the carburetor depicted in FIG. 7, illustrating the sealed pathway between the fuel chamber and the main jet.
Figure 8:
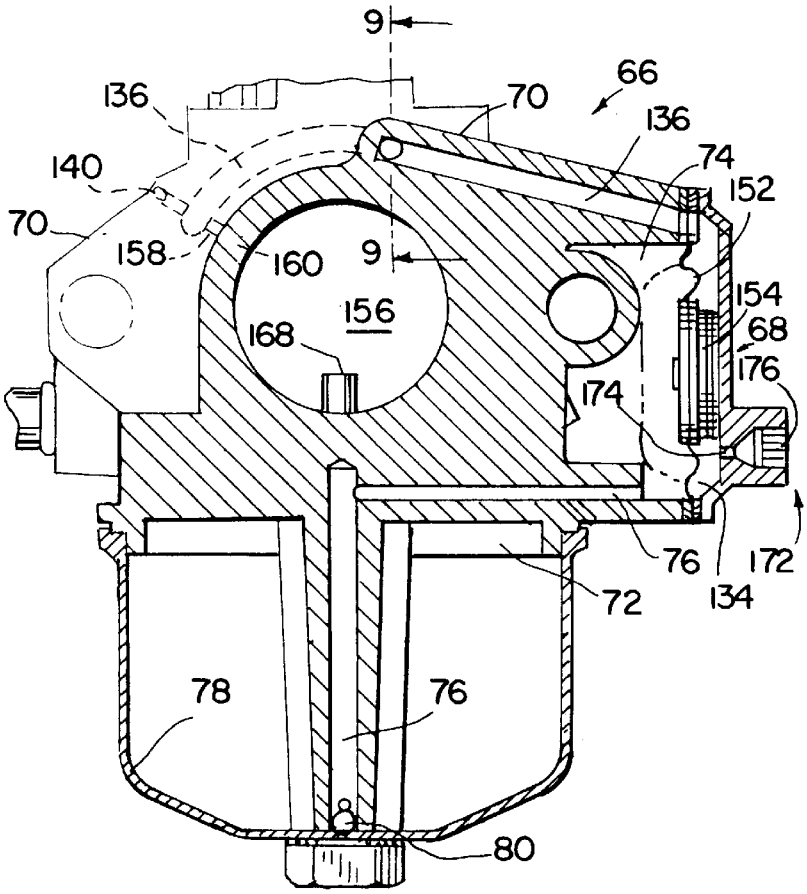
FIG. 8 is a sectional end view of the carburetor illustrated in FIG. 7, taken through line 8—8, depicting the accelerator disposed above the fuel bowl and having a sealed pathway.
Figure 9:
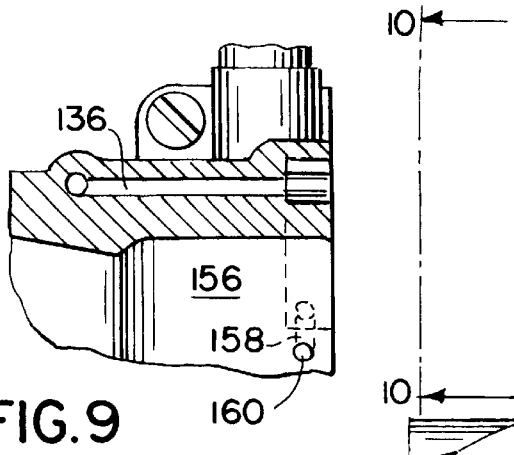
FIG. 9 is a partial sectional side view, taken through line 9—9 in FIG. 8, illustrating a passageway and a restrictor between the pneumatic chamber of the accelerator and the throat.
Figure 10:
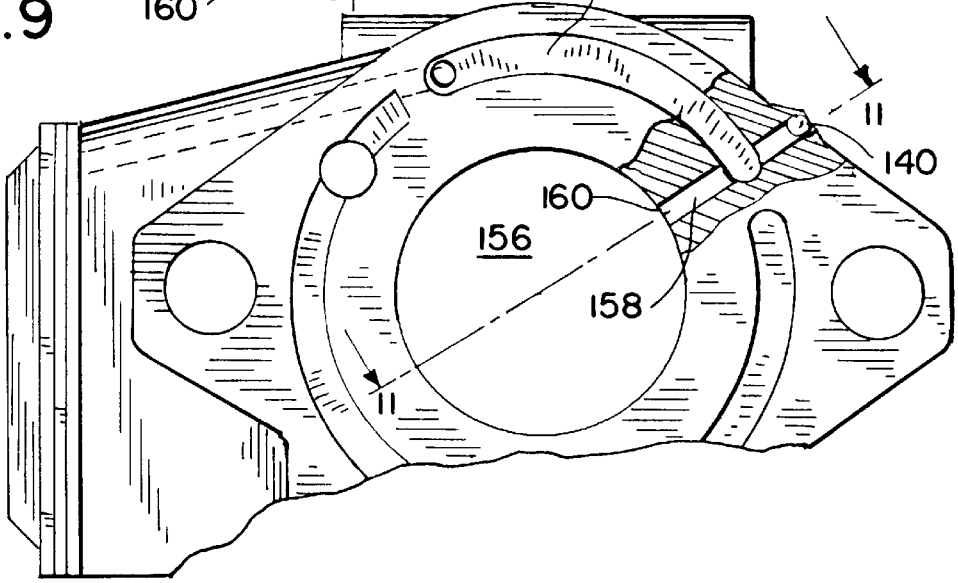
FIG. 10 is a partial end view of the restrictor portion of the passageway between the pneumatic chamber of the accelerator and the carburetor throat, depicting the pneumatic chamber opening in the carburetor throat.

Referring to FIGS. 7–8, the fuel chamber 74 does not have an air discharge opening that is in fluid communication with the fuel bowl 150, as in the previous embodiment illustrated in FIGS. 1–6. The illustrated carburetor 66 is provided with a plurality of plug members 80 that each seal an end of an opening that was formed during the manufacturing process (see e.g., FIG. 7A). Thus, a sealed pathway 76 between the fuel bowl 78 and the fuel chamber 74 is provided through which fuel may be drawn upon retraction of the diaphragm 152 and pushed forward into the main jet 164 and out a fuel nozzle opening 168 upon expansion of the diaphragm 152. In some engine applications, a slight vacuum in the fuel chamber 74 will be sufficient to maintain fuel in the fuel chamber 74 after the diaphragm 152 has been moved to its retracted position.

Alternatively, in applications where a slight vacuum is insufficient to maintain fuel in the fuel chamber 74 or where sufficient vacuum is unobtainable, a fluid trap or some conventional means for breaking a siphon effect (i.e., high point vent) may be provided in the sealed pathway 76. In any case, the damper 172 helps to prevent undesirable backflow of fuel from the fuel chamber 74 by steadying the movement of the spring 154. In most other respects, the carburetor 66 illustrated in FIGS. 7–11 functions similarly to the carburetor illustrated in FIGS. 1–6.

Figure 12:
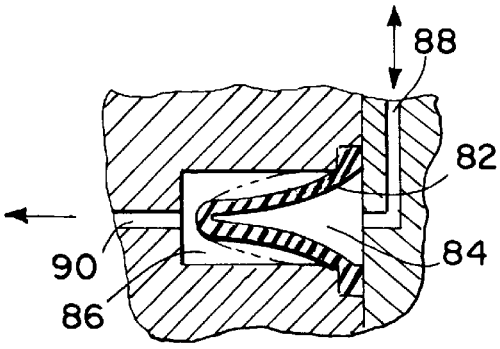
FIG. 12 illustrates an alternative embodiment of the present invention, wherein the moveable member is a flexible bladder, the bladder depicted in the retracted position.
Figure 11:
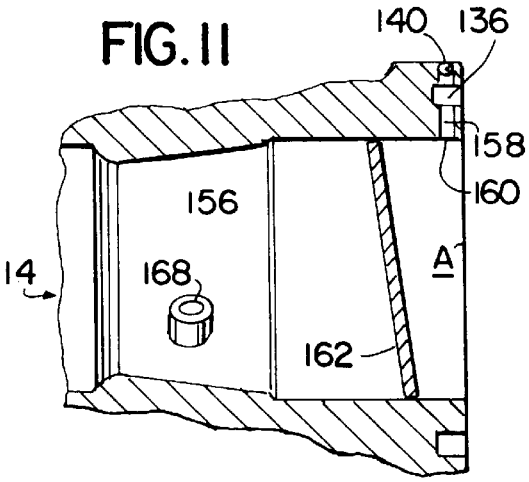
FIG. 11 is a partial sectional view, taken through line 11—11 in FIG. 10, illustrating the arrangement of the fuel nozzle opening, the throttle, and the pneumatic chamber opening in the throat.

FIG. 12 illustrates a bladder 82 that could be used instead of the above-described diaphragm. The bladder 82 is positioned so as to divide a cavity into a pneumatic chamber 84 and a fuel chamber 86. The bladder 82 is made from a flexible material, and is dimensioned so that it will deflect from a retracted position (shown in solid lines in FIG. 12) to an expanded position (shown in dashed lines in FIG. 12) as a result of changing pneumatic pressure at the input orifice 88. Such deflection of the bladder 82 results in intake and discharge of fuel through the output orifice 90.

Figure 13:
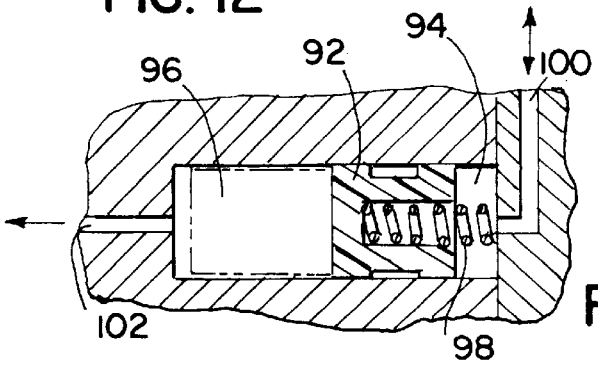
FIG. 13 illustrates another alternative embodiment of the present invention, wherein the moveable member is a piston inside a cavity, the piston depicted in the retracted position.

FIG. 13 illustrates a piston 92 that could be used instead of the above-described diaphragm or bladder. The piston 92 is positioned so as to divide a cavity into a pneumatic chamber 94 and fuel chamber 96. The piston 92 is dimensioned to substantially match the interior dimensions of the cavity, but to be slidable therein. A spring 98 biases the piston 92 toward the fuel chamber 96. The piston 92 will move within the cavity from a retracted position (shown in solid lines in FIG. 13) to an expanded position (shown in dashed lines in FIG. 13) as a result of changing pneumatic pressure at the input orifice 100. Such deflection of the piston 92 results in intake and discharge of fuel through the output orifice 102.

Although the embodiments depicted and described herein relate to a mechanical carburetor, the present invention may be used with other types of charge forming devices, such as electronically-controlled carburetors and fuel injection systems.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A charge forming device for use with an internal combustion engine, said charge forming device comprising:

a body having an intake passageway;

an accelerator device having a pneumatic chamber that is operatively interconnected with said intake passageway such that pressure fluctuations in said intake passageway is communicated to said pneumatic chamber; and a damper operative with said pneumatic chamber to damp low vacuum pressures communicated to said pneumatic chamber by increasing the pressure applied to said pneumatic chamber to a pressure that is 2 psi to 11 psi greater than the lowest vacuum pressure in said intake passageway, said damper including a damping orifice designed to draw gas from a gas source into said pneumatic chamber in response to low vacuum pressures communicated to said pneumatic chamber.

2. A charge forming device as claimed in claim 1, wherein said damping orifice has a cross sectional area less than about 0.002 square inches.

3. A charge forming device as claimed in claim 1, wherein said damping orifice has a cross sectional area less than about 0.0005 square inches.

4. A charge forming device as claimed in claim 1, wherein said damping orifice has a cross sectional area of about 0.00018 square inches.

5. A charge forming device as claimed in claim 1, wherein said pneumatic chamber is partially defined by a chamber wall, and wherein said damping orifice is in said chamber wall.

6. A charge forming device as claimed in claim 1, wherein said gas source is ambient air.

7. A charge forming device as claimed in claim 1, wherein said damper further comprises a filter operatively positioned between said pneumatic chamber and said gas source.

8. A charge forming device as claimed in claim 1, further comprising:

a main fuel chamber; and a variable volume fuel chamber that is operatively interconnected with said main fuel chamber, wherein the volume of said variable volume fuel chamber is responsive to pressure in said pneumatic chamber.

9. A charge forming device as claimed in claim 8, further comprising:

a vent passageway, distinct from said damper, in fluid flow communication with said main fuel chamber, wherein said vent passageway is adapted to permit a gas to pass through said vent passageway from said variable volume fuel chamber.into said main fuel chamber, but substantially prevents the passage of fuel through said vent passageway.

10. A charge forming device as claimed in claim 8, wherein said variable volume chamber is positioned above the fuel level in said main fuel chamber, said charge forming device further comprising:

a movable member disposed between said pneumatic chamber and said fuel chamber, such that fuel is drawn from said main fuel chamber into said fuel chamber upon retraction of said movable member in response to pressure in said pneumatic chamber.

11. A charge forming device for use with an internal combustion engine, said charge forming device comprising:

a body having an intake passageway;

a main fuel chamber;

an accelerator device including a pneumatic chamber that is operatively interconnected with said intake passageway such that pressure fluctuations in said intake passageway is communicated to said pneumatic chamber; and a variable volume fuel chamber that is operatively interconnected with said main fuel chamber, wherein the volume of said variable volume fuel chamber is responsive to pressure fluctuations in said pneumatic chamber, said variable volume fuel chamber having a vent passageway in fluid flow communication with said main fuel chamber, wherein said vent passageway is adapted to permit a gas to pass through said vent passageway from said variable volume fuel chamber into said main fuel chamber, but substantially prevents the passage of fuel through said vent passageway.

12. A charge forming device as claimed in claim 11, further comprising:

a damper, distinct from said vent passageway, that damps pressure fluctuations communicated to said pneumatic chamber.

13. A charge forming device as claimed in claim 12, wherein said damper is adapted to damp low vacuum pressures communicated to said pneumatic chamber by increasing the pressure applied to said pneumatic chamber to a pressure that is 2 psi to 11 psi greater than the lowest vacuum pressure in said intake passageway.

14. A charge forming device as claimed in claim 12, wherein said damper includes a damping orifice designed to draw gas into said pneumatic chamber in response to vacuum pressures communicated to said pneumatic chamber.

15. A charge forming device as claimed in claim 14, wherein said damping orifice has a cross sectional area less than about 0.002 square inches.

16. A charge forming device as claimed in claim 14, wherein said damping orifice has a cross sectional area less than about 0.0005 square inches.

17. A charge forming device as claimed in claim 14, wherein said damping orifice has a cross sectional area of about 0.00018 square inches.

18. A charge forming device as claimed in claim 14, wherein said pneumatic chamber is partially defined by a chamber wall, and wherein said damping orifice is in said chamber wall.

19. A charge forming device as claimed in claim 14, wherein said damping orifice is in fluid communication with ambient air such that said damping orifice draws ambient air into said pneumatic chamber in response to vacuum pressures communicated to said pneumatic chamber.

20. A charge forming device as claimed in claim 14, wherein said damper further comprises a filter for filtering gas drawn through said damping orifice.

* * * * *

UNITED STATES PATENT AND TRADEMARK OFFICE

CERTIFICATE OF CORRECTION

PATENT NO. : 5,843,345
DATED : December 1, 1998
INVENTOR(S) : Thomas G. Guntly

It is certified that error appears in the above-indentified patent and that said Letters Patent is hereby corrected as shown below:

Column 10, line 14, after chamber, delete "." and insert -- --.

Signed and Sealed this

Twenty-first Day of September, 1999

*Attest:*

Q. TODD DICKINSON

*Attesting Officer*

*Acting Commissioner of Patents and Trademarks*